US006070623A

United States Patent [19]

Aneas

[11] Patent Number: 6,070,623

[45] Date of Patent: Jun. 6, 2000

[54] CONNECTING DEVICE, IN PARTICULAR BETWEEN A RECEPTACLE WITH A STOPPER CAPABLE OF BEING PERFORATED AND A SYRINGE

[75] Inventor: Antoine Aneas, Menetrol, France

[73] Assignee: Biodome, Issoire, France

[21] Appl. No.: 09/230,798

[22] PCT Filed: Sep. 24, 1997

[86] PCT No.: PCT/FR97/01676

§ 371 Date: Feb. 9, 1999

§ 102(e) Date: Feb. 9, 1999

[87] PCT Pub. No.: WO98/13006

PCT Pub. Date: Apr. 2, 1998

[30] Foreign Application Priority Data

Sep. 25, 1996 [FR] France ..... 96 11965

[51] Int. Cl.[7] ..... B65B 1/04

[52] U.S. Cl. ..... 141/329; 141/27; 604/200; 604/201; 604/403; 604/406

[58] Field of Search ..... 141/25, 27, 319, 141/329, 330, 369, 383; 604/200, 201, 403, 405, 406, 411, 415

[56] References Cited

U.S. PATENT DOCUMENTS 3,940,003 2/1976 Larson .
3,977,555 8/1976 Larson .
4,576,211 3/1986 Valentini et al. .
5,636,660 6/1997 Pfleiderer et al. .

FOREIGN PATENT DOCUMENTS 0 126 718 A2 11/1984 European Pat. Off. .
0 679 380 A1 11/1995 European Pat. Off. .
2 256 752 8/1975 France .
2 560 049 A1 8/1985 France .

*Primary Examiner*—Steven O. Douglas
*Assistant Examiner*—Timothy L. Maust
*Attorney, Agent, or Firm*—Oliff & Berridge, PLC

[57] ABSTRACT

A connecting device (1) between a first receptacle (2) and a second receptacle (4) comprising a muff joint (4*a*), the device comprising an apparatus (5) for perforating a stopper, including a faucet (6) and a filtering chamber (7) isolated from outside by a filter (8), two independent channels (9, 10) being provided in the perforating apparatus (5) for communicating the inside of the first receptacle (2) with the faucet (6) and the filtering chamber (7) respectively, the device further comprising an element (11) for displacing with guidance the perforating apparatus (5), an element for fastening (13) the skirt (12) on the neck (2*a*), a plunger (15) mounted in the internal bore (12*a*) on which the perforating apparatus (5) are fixed, for sliding by simple pressure, and an element (16) for definitively stopping the plunger (15).

7 Claims, 2 Drawing Sheets

CONNECTING DEVICE, IN PARTICULAR BETWEEN A RECEPTACLE WITH A STOPPER CAPABLE OF BEING PERFORATED AND A SYRINGE

FIELD OF THE INVENTION

The present invention generally relates to the connection between, on the one hand, a first receptacle comprising a neck obturated by a visco-elastic stopper capable of being perforated, and, on the other hand, a second receptacle comprising a muff joint (male element).

More particularly, but not exclusively, the present invention will be introduced, defined and described with reference to the connection between, on the one hand, a first receptacle constituted by a rigid flask, for example made of glass, of which the neck is hermetically obturated by a rubber stopper adapted to be perforated, and, on the other hand, a second, likewise rigid receptacle, constituted by a syringe, itself conventionally comprising a rigid tubular body terminating in a muff joint, of the "luer lock" type for example, and a plunger mounted to slide hermetically inside the tubular body. A connection as defined hereinbefore is required in particular when it is question of preparing a medicamentous solution or suspension from an active ingredient in the form of powder or lyophilizate, contained in the first receptacle, namely the flask, and from a liquid medium, for example a solution, contained in the second receptacle, i.e. in the syringe. In such a case, the following operations are generally carried out:

SUMMARY

- the first receptacle (flask) being activated, and the second receptacle (syringe) being filled with the liquid medium, the stopper is perforated with an appropriate perforating means, belonging to the syringe or not, in order to establish a communication between the two receptacles;
- the liquid medium of the second receptable (syringe) is introduced inside the first receptacle (flask) in order to mix the liquid medium and the active ingredient in powder or lyophilizate form, the syringe being in that case disposed above the flask,
- the dissolution or suspension inside the first receptacle (flask) being complete, the assembly constituted by the flask and the syringe, connected to each other via the perforating means, is turned over in order to dispose the first receptacle above the second receptacle,
- and by pulling the plunger of the syringe, the suspension or solution of the active ingredient is extracted from the first receptacle and introduced in the second recptacle,
- the syringe containing the suspension or solution of the active ingredient is then ready to be used, possibly after an injection needle has been positioned on the muff joint of said syringe.

In order to connect two receptacles such as defined and exemplified hereinabove, in accordance with document EP-A-0 126 718, a transfer device with perforation of the stopper has already been proposed, comprising:

- on the one hand, a faucet (female piece) for tight join, for example a cone of the "luer lock" type, for tight join with the muff joint of the second receptacle, and, on the other hand, a filtering chamber isolated with respect to the outside by a filter, for example an absolute filter making it possible to sterilize any gaseous or liquid flow traversing it in one direction or in the other,

- two independent channels provided in said perforating means to establish communication between the inside of the first receptacle and the faucet and the filtering chamber respectively, in the position where the perforating means perforates the stopper, tightly with respect to the outside.

This connection device further comprises means for displacing with guidance the perforating means, constituted at least by a skirt forming an internal bore;

- means for fastening the skirt on the neck of the first receptacle to arrive at a fastened position in which the internal bore opens out on the stopper;
- means for sealing the internal bore with respect to the outside, in the fastened position of the skirt;
- a plunger on which is fixed or to which belongs the perforating means, this in order to slide by simple pressure, from an inactivated position in which the perforating end is spaced apart from the stopper, to a perforating position in which this same perforating end has passed through the stopper.

Such a device allows any non-controlled relative movement between the two receptacles in the course of connection or connected, with the result that it is difficult to master with precision the quantity of liquid medium or liquid, introduced in the first receptacle or extracted therefrom, by means of the relative movement between the plunger and the tubular body of the syringe (second receptacle) for example.

The present invention therefore has for its object a solution making it possible better to control the relative movement between the first receptacle and the second receptacle, when they are connected, so as in particular to minimize and to render constant the dead volume, i.e. liquid which cannot be drawn from the first receptacle, after connection of the two receptacles.

In accordance with the present invention, the connection device further comprises:

- means for definitively stopping the plunger in the perforating position, these means comprising a clipping member disposed on or to the side of the plunger, and a complementary stop member disposed on or to the side of the skirt, the clipping member comprising a plurality of teeth distributed around the axis of the plunger, elastic in order to be returned in centrifugal or centripetal manner, the complementary stop member consisting of an annular flank against which said teeth are blocked.

BRIEF DESCRIPTION OF THE DRAWINGS

The present invention makes reference to the accompanying drawings, in which.

Figure 1:
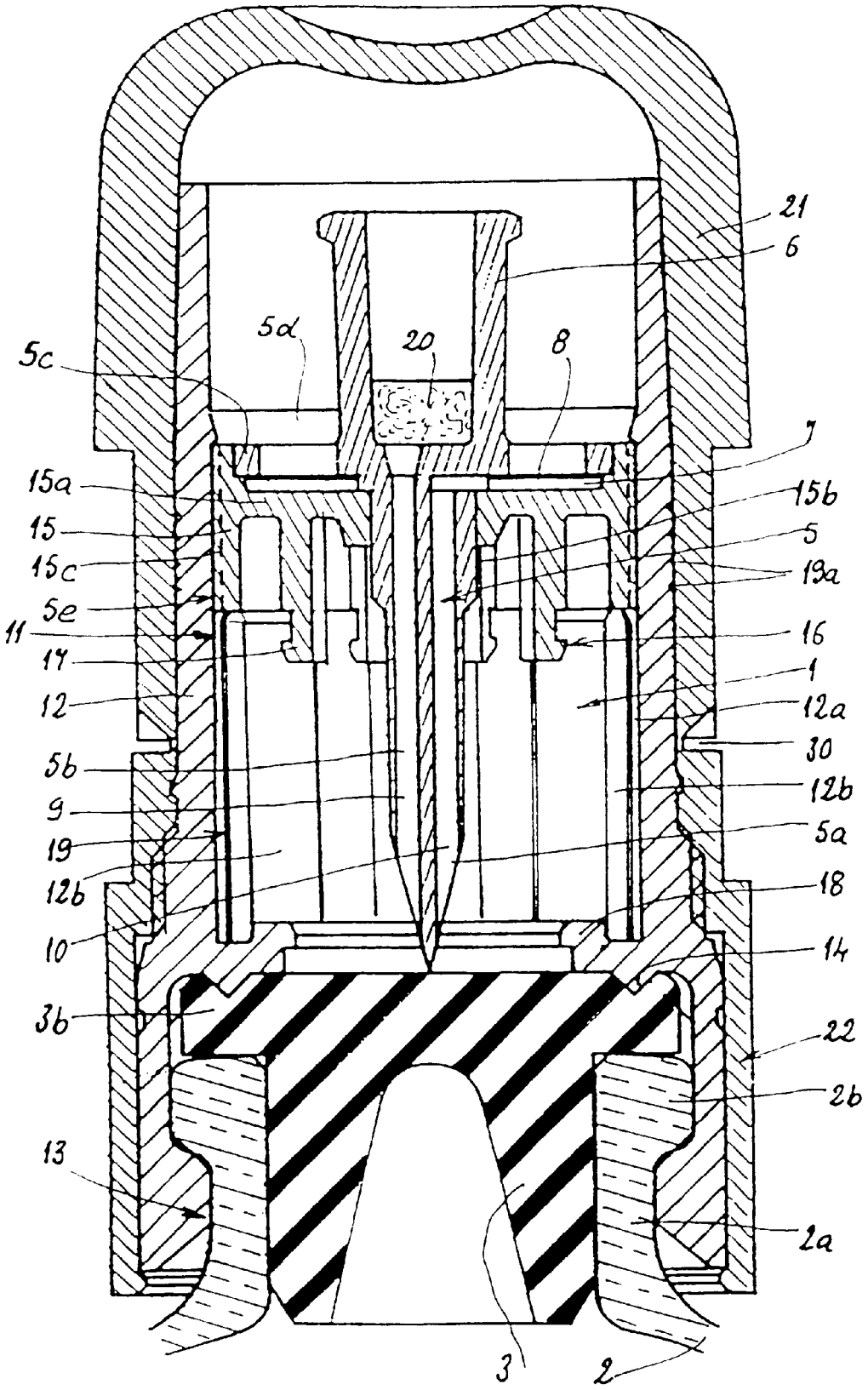
FIG. 1 shows in transverse section a connection device according to the present invention, in position fastened and locked on a first receptacle, and in the inactivated position of the plunger comprising the perforating means; in this Figure, the connection device is also shown with its cap, maintaining seal of the inside of the connection device with respect to the outside.
Figure 2:
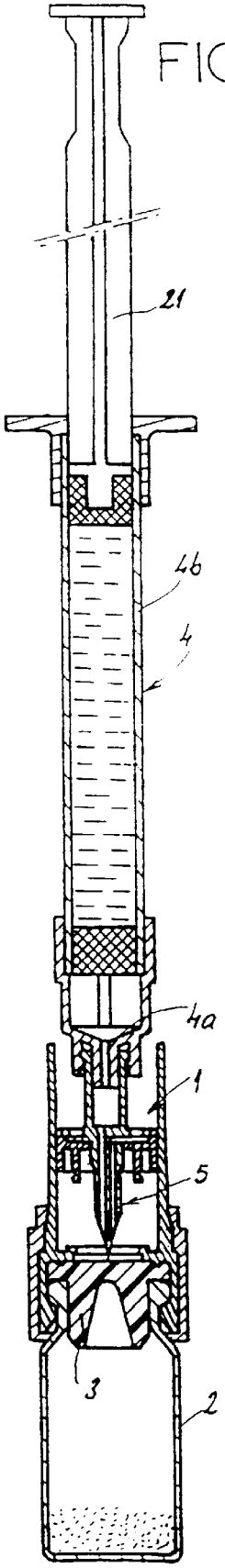

The representation of FIG. 2 differs from that of FIG. 1 in that the cap has been removed, and the second receptacle is fitted on the perforating means, in the inactivated position thereof.

Figure 3:
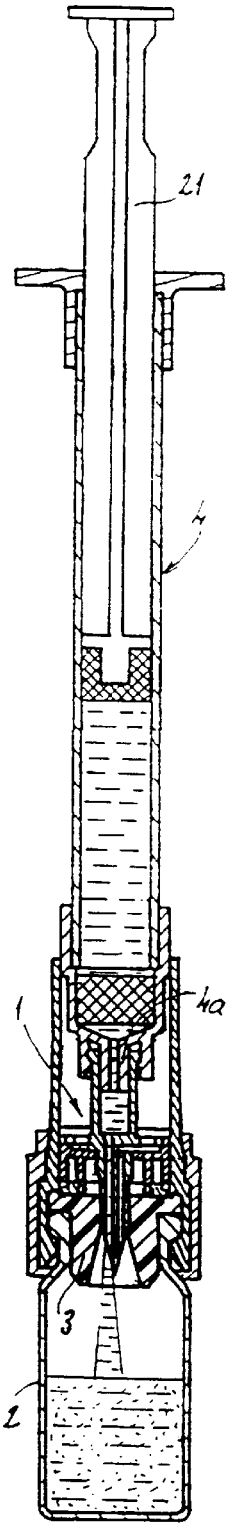

The representation of FIG. 3 differs from that of FIG. 2 in that the plunger and its perforating means are in the activated, or perforating, position with introduction of the liquid contained in the second receptacle in the first receptacle, in this example by pushing on the plunger of the syringe constituting the second receptacle.

Figure 4:
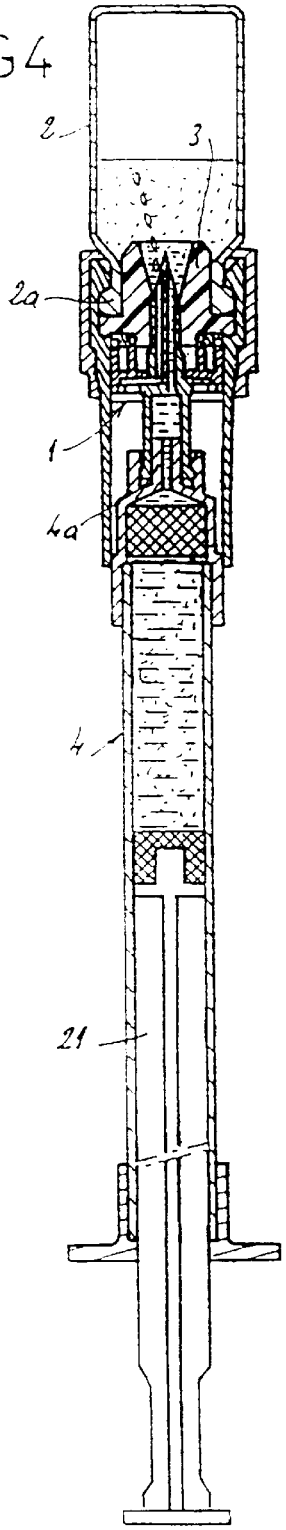

The representation of FIG. 4 differs from that of FIG. 3 in that the assembly of the two connected receptacles is overturned, and the liquid contained in the first receptacle is drawn into the second receptacle, by pulling on the plunger of the syringe for example.

DETAILED DESCRIPTION

In accordance with FIGS. 1 and 2, the connection device described hereinafter makes it possible to connect, tightly with respect to the outside, and in particular by preserving pre-established conditions of sterility:

- on the one hand, a first receptacle 2 for example a glass flask, comprising a neck 2*a* with an annular bead 2*b*, obturated by a stopper 3 made of visco-elastic material (rubber) capable of being perforated and itself comprising a shouldered part 3*b* resting flat on the annular bead 2*b* of the first receptacle; by hypothesis and in use, this flask contains under conditions of tightness (particularly with respect to any outside liquid) and of sterility, a powder or lyophilizate of an active ingredient for example,
- and on the other hand, a second receptacle, comprising a muff joint 4*a*, constituted for example by a conventional syringe, comprising a tubular body 4*b*, a cone of the "luer lock" type, added on one end of the tubular body 4*b*, forming the said muff joint, and a plunger 21 enabling the syringe to be filled or emptied as desired.

The connection device according to the invention proper, making it possible to connect the two receptacles exemplified hereinabove, by perforation of the stopper 3, generally comprises:

- a means 5 for perforating the stopper,
- means 11 for displacing with guidance the said perforating means, constituted at least by a skirt 12 and a plunger 15 on which the perforating means 5 is mounted or to which it belongs,
- means 13 for fastening the skirt 12 on the neck 2*a* of the first receptacle,
- means 14 for sealing the inside of the skirt 12 with respect to the outside, employing the visco-elastic characteristics of the upper part of the stopper 3,
- and means 16 for definitively stopping the plunger 15 in the perforating or perforation position, represented for example in FIGS. 3 and 4.

The perforating means 5 comprises, as shown in FIG. 1, a central or axial part 5*b* terminating in a perforating end 5*a*, a collar 5*c* allowing fixation of the perforating means on the plunger defined hereinafter, in which a circumferential opening 5*d* is made, and a faucet (female element) 6, extending the axial part 5*b*, and ensuring a tight join with the muff joint (male element) 4*a* of the second receptacle (syringe). At the level of the perforating means 5, opposite the perforating end 5*a* hereinafter, a filtering chamber 7 is formed between a bevel shoulder provided in the plunger 15, defined hereinafter, and a filter 8, maintained clamped between the collar 5*c* and a corresponding shoulder provided on the plunger 15, and isolating said chamber with respect to the outside. The faucet 6, disposed on the side opposite the perforating end 5*a*, comprises a filter 20 for filtering any liquid traversing it in one direction or in the other. Two independent channels 9 and 10 are made in the axial part 5*b* of the perforating means 5, to establish communication between the inside of the first receptacle 2 and the faucet 6 and the filtering chamber 7 respectively, in the perforating position shown in FIGS. 2 to 4 for example, in which the perforating means 5 perforates the stopper 4, having traversed it completely by its perforating end 5*a*.

The means 11 for displacing the perforating means 5 with guidance are constituted by the cooperation of the tubular skirt 12, forming an internal bore 12*a*, and of the plunger 15 mounted in the internal bore 12*a*, on which is fixed or mounted the perforating means 5. The skirt 12 is obtained in one piece with the fastening means 13, for example made of plastic material, and as shown in FIG. 1 may extend upwardly, beyond the free end of the faucet 6, in order to prevent an accidental actuation of the plunger by the user's fingers. Furthermore, it is provided with a capsule forming fastening means 13, capable of clipping with respect to and beneath the annular rim 2*b* of the receptacle 2, in contact with the neck 2*a*, and this thanks to a radial elasticity enabling it to return the circumferential lower edge into centripetal position. In practice, this fastening capsule 13 is constituted by a plurality of fastening teeth, together forming the capsule defined hereinabove, and each presenting the radial elasticity mentioned above. In the fastened position shown in FIGS. 1 to 4, the internal bore 12*a* opens out on the stopper 3 and more particularly its upper part accessible to the perforating end 5*a* of the perforating means 5. Means 14 for sealing the internal bore 12*a* with respect to the outside and using the visco-elastic properties of the stopper 3, are likewise constructed in one piece with the skirt 12; these means consist in particular in a continuous, relatively hard, circumferential rib penetrating at least partially in the relatively soft material of the stopper 3.

The plunger 15 comprises a transverse core 15*a* comprising a shouldered orifice 15*b* allowing the passage of the axial part 5*b* of the perforating means 5, with axial hold of said means. As stated hereinbefore, the perforating means 5 is furthermore retained hermetically by its collar 5*c*, on the shoulder defined by the bevel of the filtering chamber 7. By being blocked in rotation with respect to the skirt 12 by the means defined hereinafter, the plunger 15, mounted in the internal bore 12*a*, may slide, by simple axial pressure, from an inactivated position (cf. FIGS. 1 and 2), in which the perforating end 5*a* is spaced apart from the stopper 3, and a perforating position (cf. FIGS. 3 and 4), in which the perforating end 5*a* has completely traversed the stopper 3. The means 19 for blocking in rotation the plunger 15 with respect to the skirt 12 are obtained by making, towards the skirt 12 on its inner surface, eight grooves parallel to the axis of the device, distributed over the periphery of said skirt, and, towards the plunger, eight corresponding ribs (not shown), capable of engaging respectively in the said grooves.

The means 16 for definitively stopping the plunger 15, and consequently the perforating means 5 in the perforating position, in which the perforating end of the means 5 has completely traversed the stopper 3, comprise:

- one or more clipping members 17, belonging to the plunger 15, constituted by teeth distributed about the axis of the plunger 15, which are elastic in order to be returned in centrifugal or centripetal manner; these clipping members 17 together form a ring concentric with the axis of the plunger 15, inside the skirt 15*c* ensuring slide of the plunger in the internal bore 12*a*,
- and one or more complementary stop members 18, disposed on the skirt 12, consisting for example of an annular flank 18, against which or under which the teeth 17 are blocked when the plunger 15 is displaced towards the stopper 3.

The cap 21 is mounted tightly on the skirt 12 in order to contain the faucet 6 and the other internal parts of the device, namely the plunger 15 and the perforating means 5, in isolated manner with respect to the outside, this by hermetically closing the inner part of the skirt 12, opposite the stopper 3. Such seal is obtained in particular thanks to a succession of circumferential plates 19*a* arranged on the outer surface of the skirt 12, and on which the cap 21 is blocked.

The term "seal" is understood to mean a seal with respect to at least liquids, and enabling in particular conditions of sterility to be maintained inside the connecting device.

Furthermore, the connecting device according to the invention is definitively fixed on the first receptacle 2. To that end, it integrates means 22 for definitively locking the device on the first receptacle 2, blocking the fastening means 13 in their position fastened on the neck 2*a* of the receptacle 2. These locking means consist in particular in an outer ring, constructed in one piece with the cap 21, but separate therefrom by a line of weakening 30 making it possible to separate the cap from the connecting device.

Functioning of the connecting device 1 according to the present invention is deduced from the representations of FIGS. 2 to 4, explained by reference to the enumerative of the Figures, and to the second paragraph of the present description.

A device as described hereinabove presents, in addition, different important advantages:

- it is one-use, since, in particular, the means 16 for definitively stopping the plunger 15 exclude another re-use,
- it is completely safe to use, the user at no moment being able to touch the perforating end 5*a* of the perforating means 5 with his/her fingers, since, in particular, the displacement and guidance of the plunger 15 require no intervention other than its being pushed by the muff joint of the syringe.
- the user has no functional need to touch the plunger 15 and/or the perforating means 5 with his/her fingers, and in particular there is no risk of accidental injury.

I claim:

1. Device (1) for connection between, on the one hand, a first receptacle (2) comprising a neck (2*a*) obturated by a visco-elastic stopper (3) capable of being perforated, and, on the other hand, a second receptacle (4) comprising a muff joint (male element) (4*a*), said device comprising a means (5) for perforating the stopper, comprising on the side opposite the perforating end (5*a*) of said perforating means, on the one hand, a faucet (female element) (6) for tight join with the muff joint (4*a*) of the second receptacle (4), and, on the other hand, a filtering chamber (7) isolated with respect to the outside by a filter (8), two independent channels (9, 10) being made in the perforating means (5) for establishing communication between the inside of the first receptacle (2) and the faucet (6) and the filtering chamber (7) respectively, in the position where the perforating means (5) perforates the stopper (3), said device further comprising means (11) for displacing with guidance the perforating means (5), constituted at least by a skirt (12) making an internal bore (12*a*), means (13) for fastening the skirt (12) on the neck (2*a*) of the first receptacle (2) in a fastened position in which the internal bore (12*a*) opens out on the stopper (3), with means (14) for sealing the internal bore (12*a*) with respect to the outside, a plunger (15) on which is fixed the perforating means (5), to slide by simple pressure from an inactive position in which the perforated end (5*a*) is spaced apart from the stopper (3), and a perforating position in which said perforating end (5*a*) has traversed the stopper (3), characterized in that the device further comprises means (16) for definitively stopping the plunger (15) in the perforating position, comprising a member (17) for clipping on the plunger, and a complementary stop member (18) on the skirt, the clipping member comprising

- a plurality of teeth (17) distributed about the axis of the plunger (15), which are elastic in order to be returned centrifugally or centripetally, and the complementary stop member consisting of an annular flank (18) against which said teeth (17) are blocked.

2. Device according to claim 1, characterized in that means (19) for blocking in rotation are arranged between the plunger (15) and the skirt (12).

3. Device according to claim 1, characterized in that the second receptacle (4) is a syringe, and the faucet is a "luer lock" cone (6).

4. Device according to claim 1, characterized in that the filter (8) has a porosity ensuring a sterile filtration of all gaseous or liquid flow traversing it.

5. Device according to claim 1, characterized in that it comprises a cap (21) mounted on the skirt (12) to contain the faucet (6), arranged to hermetically close that part of the skirt (12) opposite the stopper (3).

6. Device according to claim 1, characterized in that it comprises means (22) for definitively locking on the first receptacle (2), blocking the fastening means (13) in their position fastened on the neck (2*a*) of the recipient.

7. Device according to claim 1, characterized in that the faucet (6) comprises a filter (20) for filtering any liquid traversing it.

* * * * *